United States Patent [19]

Schwab

[11] Patent Number: 4,594,060

[45] Date of Patent: Jun. 10, 1986

[54] ROTARY PUMP FOR BLOOD AND OTHER SENSITIVE LIQUIDS

[76] Inventor: Walter Schwab, Kahlsperg 694, A-5411 Oberalm, Austria

[21] Appl. No.: 734,762

[22] Filed: May 15, 1985

Related U.S. Application Data

[63] Continuation of Ser. No. 493,694, May 11, 1983, abandoned.

[30] Foreign Application Priority Data

May 12, 1982 [AT] Austria ..... 1857/82
Jan. 20, 1983 [AT] Austria ..... 171/83

[51] Int. Cl.[4] ..... F04C 2/22; A61F 2/22; A61M 1/12

[52] U.S. Cl. ..... 418/54; 418/152; 128/1 D; 128/DIG. 3; 623/3

[58] Field of Search ..... 418/54, 61 A, 113, 152, 418/153; 3/1.7; 128/1 D, DIG. 3; 623/3

[56] References Cited

U.S. PATENT DOCUMENTS 807,421 12/1905 Dickison ..... 418/113
4,218,199 8/1980 Eiermann ..... 418/54
4,296,500 10/1981 Monties et al. ..... 418/54

FOREIGN PATENT DOCUMENTS 2242247 3/1974 Fed. Rep. of Germany ..... 418/54
583035 12/1946 United Kingdom .

OTHER PUBLICATIONS

"Pulsatile Flow Blood Pump Based on the Wankel Engine", by N. Verbiski et al., Journal of Thoracic & Cardiovascular Surgery, vol. 57, No. 5, May 1969, pp. 753–756.

*Primary Examiner*—John J. Vrablik
*Attorney, Agent, or Firm*—Karl F. Ross; Herbert Dubno

[57] ABSTRACT

A rotary piston pump for the displacement of blood has a single-lobe trochoidal surface along the peripheral wall of a housing and an eccentrically displaced rotary piston having a pair of opposite edges confronting this surface. The edges confronting the surface are rounded of circular arc curvature with a radius less than the equidistant between the theoretical epitrochoid of the orbits of these edges and the surface. A gap seal is thus provided which prevents damage to blood vessels when the pump is used for the circulation of blood, e.g. in an artificial heart.

7 Claims, 9 Drawing Figures

ROTARY PUMP FOR BLOOD AND OTHER SENSITIVE LIQUIDS

CROSS REFERENCE TO RELATED APPLICATION

This is a continuation of co-pending application Ser. No. 493,694 filed on May 11, 1983, now abandoned.

This application is related to my concurrently filed copending application Ser. No. 493,693.

FIELD OF THE INVENTION

My present invention relates to a pump for blood and other sensitive liquids and, more particularly, to a compact blood pump which can be used in or as part of an artificial heart.

BACKGROUND OF THE INVENTION

As will be apparent from the references discussed below, it is already known to provide a rotary heart pump which comprises a piston whose path is that of a trochoid with a ratio of 1:2 and which cooperates with a single-lobe chamber to displace fluid from an inlet to an outlet, the piston being driven by an eccentric and having two lobes or corners which are juxtaposed with the surface of the chamber.

Since the outer dimensions of a pump for blood and like sensitive liquids, especially when it is to be used in or as an artificial heart, must be comparatively small, this rotary pump principle which utilizes a minimum space is especially effective.

The pump of the invention is thus intended for use wherever the displacement of blood is desirable, i.e. in clinical situations, as well as for direct implantation in patients and in animals.

It will be appreciated that heart pumps to date have usually concentrated upon a different principle. They have, for the most part, been pulsatile and have utilized membranes or pistons with the force transfer between a pressure plate and the membrane being effected hydraulically and the mechanical movement of the pressure plate being accomplished by an electromechanical, pneumatic or like drive.

The pressure plate can, for example, be operated by an electromagnetic solenoid or the membrane can be actuated directly or indirectly by compressed air or another powering fluid.

These systems have various disadvantages, prime among them being the need to dispose the power source externally of the body because of the size of the power source which must be used. Another disadvantage is the low displacement capability of the pump.

In German patent document No. DE-OS 28 19 851 (corresponding to French Pat. No. 2,389,382 and U.S. Pat. No. 4,296,500), a rotary blood pump is described which is in the form of a trochoid rotary piston pump operating analogously to the rotary pump machines described in *Einteilung der Rotations-Kolbenmaschinen*—Bauformblatt 16, which describes a trochoid rotary piston pump with a 2:3 or a 1:2 ratio utilizing contact seals between the piston and the chamber wall.

When the pump of these patents is used in a rotational heart application, the electric motor is disposed outside the pump housing and it is clear that a low-speed drive is required. This is understandable because this machine is capable of doing considerable damage to the blood cells, at least in part because of shear which develops at the contact seals at any speed, but most particularly if attempts are made to operate this pump at high speed.

Reference may be had as well to the publication entitled *Pulsatile Flow Blow Pump Based on the Principle of the Wankel Engine,* von N. Verbiski et al, Journal of Thoracic and Cardiovascular Surgery, vol. 57, 5, May 1963, pages 753–756 in which a 2:3 ratio Wankel machine is described for similar purposes (see *Einteilung der Rotations-Kolbenmaschinen,* Bauformblatt 18).

All of these rotary machines have the negative characteristic when they are used as blood pumps, that at least a stationary sealing zone of the housing contacts a rotary sealing zone on the flank of the piston so that shear effects and other stresses are applied to the blood cells and at least the red blood corpuscles of the blood are mechanically broken up or damaged, thereby releasing hemoglobin and provoking hemolysis which is at the very least detrimental to a patient.

This is especially the case when the rotary pump must be operated at 200 revolutions per minute or more.

OBJECTS OF THE INVENTION

It is the principal object of the present invention to provide a improved blood pump and especially an implantable blood pump of minimal size and weight, with high output and the capability of operating at speeds of say 200 revolutions per minute with minimum damage or stress to the blood.

Another object of this invention is to provide an improved rotary pump which can be implanted in human patients or in animals and which can provide one or more of the pumping functions of the heart in whole or in part without the drawbacks of earlier heart pumps as described previously.

Another object of this invention is to provide a pump for emulsions or suspensions which is operable at high rates and yet does minimal damage to any cellular substances which may be found in the emulsions or suspensions.

Still another object of this invention is to provide a blood pump and more specifically a pump for use as or in an artificial heart which does not induce premature hemolysis.

SUMMARY OF THE INVENTION

These objects which will become apparent hereinafter are attained in accordance with the invention in a trochoid rotary piston pump in a 1:2 ratio having an eccentrically driven piston with two edges juxtaposed with a single-lobe surface of the pump chamber receiving this piston and wherein the piston edges are rounded in the form of circular arcs whose radii are slightly smaller than the mathematical distance or length of the equidistant between the theoretical epitrochoid and the trochoidal surface of the housing. The centers of these circular curvatures are each defined by the intersections of the epitrochoid and the axis of symmetry running through these edges or are located as close as possible to such intersections so that the path described by the edges formed with the circular curvatures is either identical to that of the theoretical epitrochoid or is so similar to the latter that a minute gap is formed between the path of these edges and the trochoidal surface that a gap seal is formed between the edges and the surface. The flanks of the piston and the juxtaposed lateral walls of the housing also can have a constant spacing of a width of the order of a micron between them so that direct contact is completely eliminated, shear stress on blood cells and the like is minimized and yet leakage of blood between the compartments on opposite sides of the rotary piston is minimal.

A gap seal is a seal between the moving member and the stationary member which maintains the two out of direct contact, but yet provides a gap whose width is not sufficient to permit leakage past the gap to any significant extent.

It has been found to be advantageous to form each of these corners by a pin, rod or bar, hereinafter referred to as a sealing bar, of circular cross section to define the circular configuration of the edge.

This bar can extend the full axial length of the piston and also can be in whole or in part formed from elastic material.

The bar can have a portion slidably engaging the surface of the chamber slightly but generally has most of its surface set back from the chamber surface to define the sealing gap in the micron range.

The circular arc curvature of the bar in the region over the range of a pivot angle or over the entire cross section of the bar can have a radius approximating that of the equidistant.

Since, for the most part, the seal is of a contactless type, damage to the red blood corpuscles is minimal since these are not forced between surfaces in pressure content to bring about hemolysis.

The blood and heart pump of this invention can otherwise be of the basic type described in Bauformblatt 18 of *Einteilung der Rotations-Kolbenmaschinen* of F. Wankel, utilizing a 1:2 transmission ratio. This type of pump with its 1:2 transmission ratio in the system of the invention provides no stationary sealing site on the chamber surface for the piston so that all the sealing of the two piston compartments is effected at the gap seals described.

According to another feature of the invention, the intake and discharge openings can be provided peripherally or laterally in the manner described in German patent document DE-OS No. 22 42 247 for a rotary piston pump or in Austrian Pat. No. 355 177 for a compressor.

Where the intake and discharge openings are formed as peripheral ports, in the deadpoint positions of the piston of the two pump compartments, each can have a maximum and minimum volume since the intake and discharge openings in the deadpoint positions lie directly opposite the piston edges and the piston edges serve as valves for these ports so that additional valves which might be detrimental to the blood are unnecessary.

If the intake opening is a peripheral opening and the discharge opening is a lateral opening, or conversely the intake opening is a lateral opening and the discharge opening is a peripheral port, in the deadpoint position of the piston a back flow in the pump is prevented by forming the lateral port in the deadpoint position so that it is closed by the leading as well as by the trailing piston edges.

According to a feature of the invention the rotary pump can have its intake and discharge openings exclusively as lateral openings. In this case, in the deadpoint position of the piston one of the lateral ports is covered by both the leading and trailing piston flanks and one of the piston edges while the other lateral port is covered by the leading and trailing flanks of the other piston edge. In this case, in the deadpoint position of the piston, both the intake and discharge openings are blocked and pressure equilization in the pump can be effected.

It has been found to be advantageous, moreover, to increase the throughput of the pump and to avoid physiologically detrimental intake suction pressures, to form the intake opening with a larger cross section than the discharge opening.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
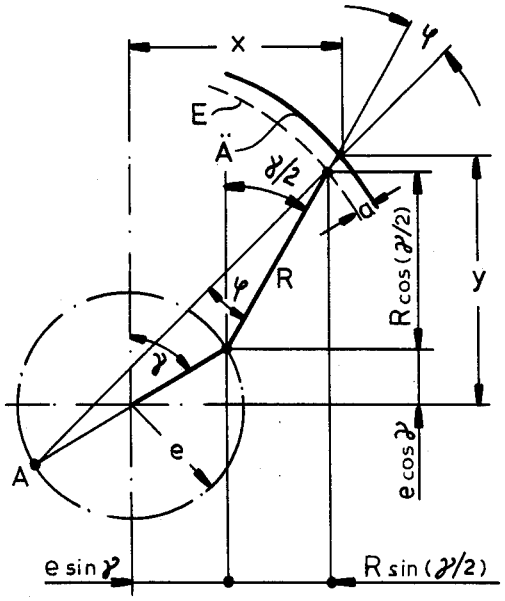
FIG. 1 is a geometric diagram illustrating various concepts for use in the description of the pump.
Figure 2:
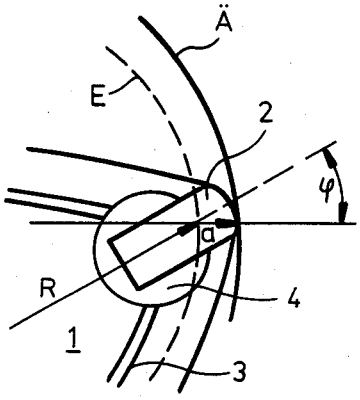
FIG. 2 PRIOR ART
FIG. 2 is a detail view of a piston edge of the type provided in a Wankel engine.

In FIG. 1 I have provided a diagram which can be used to demonstrate the principles of the present invention which illustrates the definition of a single-lobe trochoidal surface. The equations defining the single-lobe epitrochoid are:

$$x=e\cdot\sin\gamma+R\cdot\sin\gamma/2 \quad (1)$$

$$y=e\cdot\cos\gamma+R\cdot\cos\gamma/2 \quad (2).$$

The sealing bars whose running surface is to exactly follow this epitrochoid must have a point or tip, i.e. must terminate in an edge. If the seal is to have a given width, the surface against which the seal lies must follow the epitrochoid E at a small constant distance a outwardly therefrom. The distance a between the epitrochoid and the surface Ä is defined as the equidistant since the trochoidal surface Ä forming the wall of the housing lies at this constant distance a from the epitrochoid E.

The equations for the trochoid Ä augmented by the equidistant a are:

$$x=e\cdot\sin\gamma+R\cdot\sin(\gamma/2)+a\cdot\sin(\gamma/2+\phi) \quad (3)$$

$$y=e\cdot\cos+R\cdot\cos(\gamma/2)+a\cdot\cos(\gamma/2+\phi).$$

These equations involve the traverse angle or swing angle $\phi$ which is defined between the generating radius R and the normal to the path $\phi$ can be given by the equation $$\phi = \text{arcoss}\frac{R + 2e \cdot \cos\frac{\gamma}{2}}{R^2 + 4e^2 + 4R \cdot e \cdot \cos\frac{\gamma}{2}} \quad (5)$$

$\phi$max is obtained when the angle at A is a right angle:

$$\sin \phi_{max} = 2e/R. \quad (6)$$

In the usual Wankel machine or where such trochoid paths are followed by rotors in rotary piston means heretofore, as can be seen from FIG. 1, at the edge for corner 1 of the piston, a radial sealing bar 2 can be provided which can have a radius at least equal to the equidistant a or projects by a distance at least equal to this equidistant a so that this sealing bar is in continuous contact with the trochoid surface X.

For the reasons advanced, such a seal is not suitable for use in a pump for the displacement or circulation of blood. The sealing surfaces which are in sliding contact with one another, apparently induce shear within the cellular structure of the blood to bring about premature hemolysis.

Figure 3:
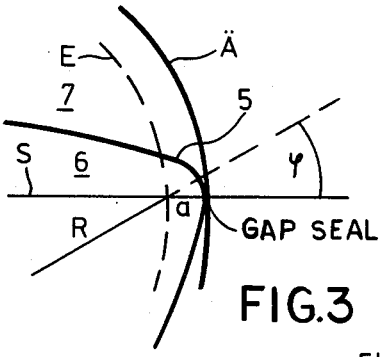
FIG. 3 is a detail view of a piston edge of the type used in the present invention for a blood and heart pump.

This can be avoided, according to the invention, when the sealing is effected by the approach illustrated with respect to FIG. 3.

From FIG. 3 it will be apparent that the piston corner or edge 6 should have a circular arc contour whose radius 5 is smaller slightly than the mathematical spacing corresponding to the equidistant a between the theoretical epitrochoid E and the trochoidal surface Ä of the peripheral wall of the pump housing.

The center of this circular arc curvature should lie at the intersection of the epitrochoid E and the axis of symmetry through the two piston corners or edges, or the line representing the radius R in FIG. 3. The symmetry plane is represented at S and it may also be seen that this arc should extend angularly at least over the angle $\phi$ measured between the radius R and the plane S. If it is not possible to place the center of curvature precisely at this intersection, the center should be as close as possible to the intersection so that the center of curvature describes a line, on rotation of the piston or rotor, which coincides precisely with the theoretical epitrochoid or is as close as possible to the latter while the outermost point of the arc lies inwardly of the surface Ä by a gap whose width is of the order of a micron.

Figure 3A:
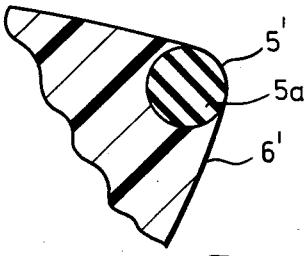
FIG. 3*a* is a sectional view illustrating the construction of the edge portion.

This gap creates a so-called gap seal so that there need not be actual contact between the surface of the rotary piston and the trochoid surface Ä. However, the constant gap width between these members is such that normally the liquid or other fluid to be displaced cannot pass readily through the gap and thus the sealing effect is similar to that which obtains when direct contact is provided, but the possibility of damage to red blood cells or the like is minimized. As has been seen in FIG. 3*a*, preferably the sealing surface 5' forming the gap seal and having the circular inner curvature described is formed by a pin, bar or rod, of circular cross section which is set into the piston. In FIG. 3*a*, this bar is presented at 5*a* and is set into the corner or edge of the rotary piston 6'.

Since there is no direct contact in this embodiment, the piston itself can displace the blood slowly with a speed corresponding substantially to the pulse frequency and can be below 200 revolutions per minute. The radius 5 or 5' of curvature of the sealing surface is substantially greater than the radius of the conventional sealing edges of Wankel engines and the sealing surfaces which are juxtaposed closely with the trochoidal surface Ä are likewise greater.

The lateral walls 10' and 11' define micron-width gaps with the rotary piston.

Figure 3C:
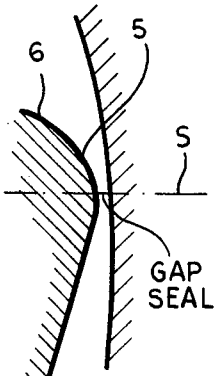
FIG. 3*c* is a greatly enlarged view of a portion of FIG. 3.
Figure 4:
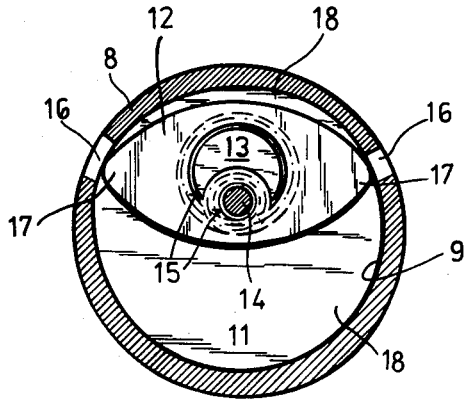
FIG. 4 is a cross-sectional view taken perpendicular to the axis of rotation of a trochoid rotary piston pump seen in its deadcenter position and having peripheral ports.
Figure 5:
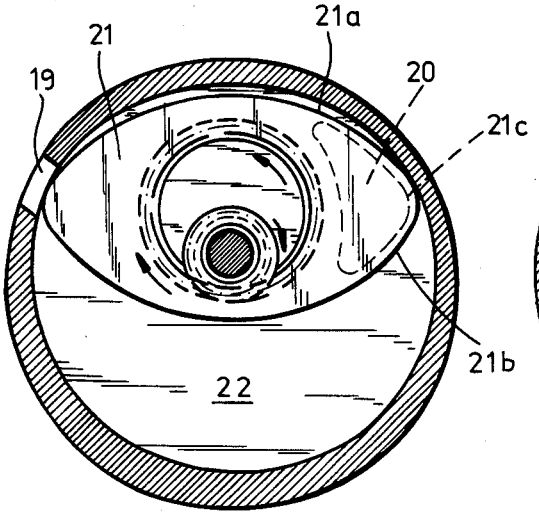
FIG. 5 is a rotary section through a trochoidal rotary piston pump showing the deadcenter position of the piston in an embodiment in which the pump has a peripheral and a lateral port.
Figure 6:
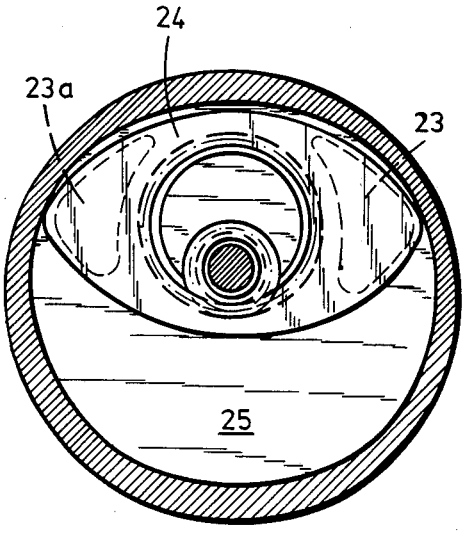
FIG. 6 is a view similar to FIG. 5 illustrating an embodiment of the invention in which the inlet and outlet ports are both formed in the lateral wall.

FIGS. 4 through 6 show a 1:2 trochoidal rotary piston pump with corners corresponding to those of FIG. 3, i.e. without direct contact with the trochoidal peripheral wall. It should be noted, that, to the extent that such a gap cannot be seen in FIG. 3, it is because the gap is extremely minute and hence difficult to show. However the gap is visible in the enlarged view of FIG. 3*c*.

It should be noted that the pump described in connection with FIGS. 4 through 7 can be driven by the electric motors and drive arrangements with the rotors or pistons and described in the above-identified concurrently filed copending application Ser. No. 493,693.

More specifically, FIG. 4 shows a rotary pump which comprises a housing whose peripheral wall 8 has an internal trochoidal surface 9 generated in the manner described and two lateral walls only one of which can be seen at 11 in this figure. A two-corner piston 12 rotatable on an eccentric 13 orbits the eccentric shaft in the trochoidal path and can be driven by a drive motor and transmission within the rotor as described in the aforementioned copending application. The eccentric shaft is represented at 14 and the shaft and piston can be coupled by a gear set 15, namely a pinion on the shaft 14 and an internal gear on the piston 12. The shaft 14 can extend through or pierce one of the lateral walls 11.

FIG. 4 also shows, in a manner described in German patent document DE-OS No. 22 42 274, intake and discharge ports 16 in the peripheral wall 8 of the housing each port having the configuration of a slot or being elongated. The intake and discharge ports 16 lie directly opposite the piston corners 17 when the piston 12 is in its dead-point position shown in FIG. 4 and one of the two pumping chambers has its maximum value while the other has its minimum value.

FIG. 5 shows another port construction which can be similar to that of Austrian Pat. No. 355 177. Here one of the ports is in the form of an elongated opening 19 in the peripheral wall while the other port 20 is a lateral port, i.e. is formed in one of the lateral walls 22 of the housing. In the dead-point position of the piston 21, the peripheral port is directly juxtaposed with one corner, while the lateral port 20 is disposed between leading and trailing flanks 21*a* and 21*b* of the piston 21 adjacent the other corner 21*c* and is blocked by the piston. The opening 20 can be provided mirror symmetrically in both of the opposite walls 22 of the housing.

In FIG. 6, I have shown still another construction in which both the intake and discharge openings are formed as lateral openings and are provided in the lateral walls. In this case two lateral openings 23 and 23*a* are provided in one of the walls 25. Naturally, a second set of such openings can be provided on the opposite wall or, if the opening 23*a* is to represent the intake opening and to have a larger cross section than the discharge opening, two such opening 23 is provided on the opposite wall.

In the dead-point position of the piston shown in the drawing the flanks of the piston cover both of the openings.

To increase the throughput and avoid physiologically detrimental suction at the intake opening, in general the latter will have a greater cross section than the discharge opening.

When the device is used as a blood pump or as an artificial heart, e.g. for either the pulmonary or peripheral circulations, the intake opening can be a peripheral port while one or two lateral ports may be provided to serve as additional intake openings or the discharge port.

In general, the device will be implanted in a patient or animal and it is therefore preferred to include the electric motor and the transmission within the rotor. However, if necessary, the electric motor or its transmission can be disposed outside the rotor and can be connected to the eccentric shaft 14. In practice, it has been found that when the electric motor is included in the rotor, it can be operated with a power of 3 to 9 watts to provide the required blood circulations. Modifications, in which the motor is disposed within the piston and the transmission is located outside the piston or the housing, where the transmission is located inside the piston and the motor is located outside the piston or the pump housing, can also be provided.

Figure 3B:
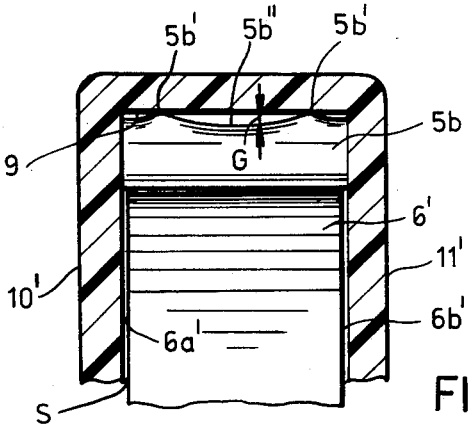
FIG. 3*b* is an axial section through the pump chamber at the edge portion, showing the gap seal with the spacing thereof greatly exaggerated.

As can be seen from FIG. 3B, the rotary piston 6' is received between the lateral walls 10' and 11' so that a constant spacing S is provided between these walls and the flanks **6*a'* and 6*b'*, the spacing S being of the order of a micron. The piston also is formed with bars 5*b* analogous to the bars 5*a* previously described, composed of an elastomeric material and bearing at locations 5*b'* slidably against the trochoidal surface 9. Between these locations and adjacent them, the bar forms the circular arc curvature 5*b''*** defining the gap seal G as previously described.

I claim:

1. A rotary blood pump for the displacement of blood, comprising:

a housing having a peripheral wall and a pair of lateral walls, said peripheral wall being rigid having a single-lobe trochoidal surface defining a pumping chamber with said lateral walls;

an intake port and a discharge port opening into said chamber and formed in said housing; and a rotary piston eccentrically mounted in said chamber and eccentrically driven therein to displace blood from said intake port to said discharge port, said rotary piston having a pair of opposite edges spacedly juxtaposed directly with said surface and describing a theoretical epitrochoid (E) upon orbiting said chamber as said rotary piston is eccentrically driven therein, said edges being formed with circular arc curvature whose radius is smaller than an equidistant (a) from the center of said curvature to said surface whereby said curvature and said surface define a gap seal having a minute constant width sufficiently small to prevent substantial blood flow therepast and sufficient to prevent damage to blood cells by shear stress as said edges sweep along said surface, said curvature having a center substantially coinciding with the intersection of said epitrochoid (E) and a piston symmetry axis extending through both of the piston edges, said lateral walls defining with corresponding flanks of said piston a minute constant spacing of a width forming a gap seal sufficiently small to prevent substantial blood flow therepast and sufficient to prevent damage to blood cells by shear stress as said flanks sweep along said lateral walls.

2. The rotary pump as defined in claim 1 wherein said intake port and said discharge port are formed as elongated openings in said peripheral wall and are located directly opposite said edges of said piston in a dead-point position thereof wherein said piston subdivides said chamber in two pumping compartments, one having a maximum volume and the other having a minimum volume.

3. The rotary pump as defined in claim 1 wherein one of said ports is formed as an elongated opening in said peripheral wall and the other of said ports is constituted by at least one opening formed in one of said lateral walls and said openings are positioned so that the opening in said peripheral wall is directly opposite one of said edges of said piston in a dead-point position thereof wherein the opening in said lateral wall lies between opposite flanks of said piston.

4. The rotary pump as defined in claim 1 wherein, to avoid physiolgically detrimental effects by suction at the intake port, the intake port has a greater cross section than the discharge port.

5. The rotary pump as defined in claim 1 wherein said ports are formed as openings in at least one of said lateal walls, said openings being covered by said piston in a dead-point position thereof wherein said piston divides said chamber into two pumping compartments, one of which is at maximum volume while the other is at minimum volume.

6. The rotary pump as defined in claim 1 wherein said curvature is formed by a circular cross section sealing bar received in the respective edge of said piston.

7. The rotary pump as defined in claim 6 wherein said bar is composed at least on part of an elastic material.

* * * * *